US007278284B1

(12) United States Patent
James

(10) Patent No.: US 7,278,284 B1
(45) Date of Patent: Oct. 9, 2007

(54) LOCK BOX FOR SEALED LATCH ASSEMBLY

(76) Inventor: Robert L. James, 209 Cardinal Cir. North, Altus, OK (US) 73521

( * ) Notice: Subject to any disclaimer, the term of this patent is extended or adjusted under 35 U.S.C. 154(b) by 0 days.

(21) Appl. No.: 11/533,717

(22) Filed: Sep. 20, 2006

(51) Int. Cl.
*E05B 67/38* (2006.01)

(52) U.S. Cl. ..... 70/56; 70/212; 70/417; 292/205

(58) Field of Classification Search ..... 70/54–56, 70/417, DIG. 43, DIG. 56, 50, 51, 202, 203, 70/211, 212; 292/148, 205, 218, 208, 281–286, 292/DIG. 32
See application file for complete search history.

(56) References Cited

U.S. PATENT DOCUMENTS

| | | | | |
|---|---|---|---|---|
| 4,010,788 | A | 3/1977 | Van Gompel | |
| 4,033,156 | A | 7/1977 | Cottingham | |
| 4,106,315 | A | 8/1978 | Dohanyos | |
| 4,676,084 | A | 6/1987 | Signorelli | |
| 4,944,168 | A | 7/1990 | Kortenbrede | |
| 5,118,149 | A | 6/1992 | Emmons | |
| 5,154,458 | A * | 10/1992 | Cook et al. | 292/218 |
| 5,168,258 | A | 12/1992 | Radke | |
| 5,743,118 | A | 4/1998 | Anderson | |
| 5,775,747 | A * | 7/1998 | Navarsky | 292/307 B |
| 5,878,604 | A * | 3/1999 | Stone et al. | 70/56 |
| 5,975,595 | A * | 11/1999 | Lorenzo | 292/205 |
| 6,009,731 | A * | 1/2000 | Emmons et al. | 70/56 |
| 6,010,166 | A * | 1/2000 | Hamilton et al. | 292/282 |
| 6,036,240 | A * | 3/2000 | Hamilton et al. | 292/202 |
| 6,233,984 | B1 | 5/2001 | Blehi, III | |
| 6,357,266 | B1 | 3/2002 | Van Buren | |
| 6,513,842 | B1 | 2/2003 | Fuehrer | |
| 6,519,982 | B1 * | 2/2003 | Brammall et al. | 70/56 |
| 6,527,312 | B1 | 3/2003 | Jackovino et al. | |
| 6,581,419 | B1 | 6/2003 | Strodtman | |
| 6,622,533 | B1 * | 9/2003 | Santini | 70/56 |
| 6,846,024 | B1 | 1/2005 | Palzkill | |
| 6,928,843 | B1 | 8/2005 | Pirnie | |
| 7,131,300 | B1 * | 11/2006 | Monasco | 70/55 |
| 7,210,316 | B1 * | 5/2007 | Falconer et al. | 70/2 |
| 2004/0040351 | A1 | 3/2004 | Alcott | |
| 2005/0247086 | A1 * | 11/2005 | Nixon, Jr. | 70/211 |

* cited by examiner

*Primary Examiner*—Lloyd A. Gall
(74) *Attorney, Agent, or Firm*—Mary M. Lee

(57) ABSTRACT

A lock box assembly for enclosing and protecting a plastic security seal on the latch assembly of the door on a cargo container or trailer. The lock box includes first and second box members that together form an enclosure for the hasp assembly that holds the seal. Cooperating latch arm slots in the sides of the box members capture the latch arm, thereby securing the lock box to the latch assembly and preventing access to the seal. Aligned holes in the sides of the box members receive a lock pin. This configuration provides a lock box that is simple in design and easy to attach and remove using any conventional lock pin. The box is secured to the latch assembly by capturing the latch arm in the slots, eliminating the need for any structure to pass through the hasps, leaving the seal undisturbed.

13 Claims, 5 Drawing Sheets

LOCK BOX FOR SEALED LATCH ASSEMBLY

FIELD OF THE INVENTION

The present invention relates generally to devices for protecting security seals on latches for cargo doors, shipping containers and the like.

BACKGROUND OF THE INVENTION

Conventional cargo carrying vehicles and shipping containers have swing-out cargo doors that include a latch assembly. The typical latch assembly, shown in FIG. 1 and designated generally by reference numeral 10, comprises a vertical locking bar 12 and a horizontally extending latch arm 14 pivotally attached to the vertical bar. The vertical locking bar 12 includes a locking cam (not shown) that engages a corresponding keeper (not shown) in the frame surrounding the cargo door 16 when the door is closed and the latch arm 14 is in a position parallel with the door. The locking cam is disengaged from the keeper when the locking arm is rotated to a position perpendicular to the cargo door allowing the door to be opened.

As shown in FIG. 1, the latch arm 14 of the latch assembly 10 is secured in a horizontal position parallel to the cargo door 16 by a hasp assembly 20. The hasp assembly 20 includes first and second hasps 24 and 26 mounted on a base plate 28. The base plate 28 is fixed to a back plate 30 that is bolted to the door 16. The first or lower hasp 24 is stationary to receive and support the latch arm 14 as it is pivoted into the engaged or latched position horizontally, as shown in FIG. 1. The second or upper hasp 26 is pivotally connected to the base plate 28 and back plate 30 to rotate within a plane generally parallel to the cargo door 16. The ends of the first and second hasps 24 and 26 are provided with aligned holes (not numbered) for receiving the shackle of a padlock (not shown) for securing the latch arm 14 within the hasp assembly 20 and preventing the cargo door 14 from being opened.

Where access to the cargo is to be limited, such as when the cargo comprises foods, chemicals, hazardous wastes, or the like, a tamper-evident security seal 34, such as a ribbon seal, a padlock seal, a cable seal, or the like, is installed through the aligned hasp holes. These seals are commercially available and typically are embossed with serial numbers. The serial number of the seal may be included on the bill of lading or shipping papers by the shipper. Upon delivery, the recipient can verify the integrity of the cargo by checking the serial number of the intact seal on the cargo door with the serial number on the billing of lading. If the seal is broken or bears a different number, the recipient may, and usually does, refuse delivery.

However, because the security seal 34 is exposed to the environment during shipment, it is vulnerable to accidental damage and to malicious damage by vandals when the cargo carrying vehicle or shipping container is left unattended. Consequently, even if no tampering or theft of the cargo occurs, the integrity of the cargo may be questioned on delivery if the seal is no longer intact. This results in unnecessary expense to the shipper and the owner of the cargo, as well as delay and inconvenience to the recipient.

SUMMARY OF THE INVENTION

The present invention provides a protective enclosure or lock box assembly for enclosing and protecting these tamper-evident security seals. The lock box assembly of the present invention includes a lock box that covers the sealed latch so that the seal is not vulnerable to damage or accessible to vandals. The box is secured to the latch assembly in a way that does not interfere with the holes in the hasps through which the seal is attached.

The present invention comprises a lock box assembly for a latch assembly comprising a latch arm engageable with a hasp assembly, where the hasp assembly comprises first and second hasps with aligned apertures therein to receive a security seal. The hasp assembly is adapted to restrain the latch arm therein.

The lock box assembly comprises a lock box that includes first and second box members. The first box member comprises a housing with side walls, and preferably has a closed end, an open end, a closed top, open bottom, and two closed sides. The first box member is sized and shaped to enclose a first portion of the hasp assembly. The sides include latch-receiving recesses, such as latch slots with open ends, and the latch slots are sized to receive a first portion of the latch arm. In addition, the first box member includes lock-receiving recesses that preferably are provided by aligned locking holes in the sides.

The second box member a housing with side walls, and preferably has an open end, a closed end, a top, and two closed sides, and is sized and shaped to enclose a second portion of the closed hasp assembly. The sides of the second box member include latch-receiving recesses, such as latch slots with open ends, and the latch slots are sized to receive at least a second portion of the latch arm. In addition, the first box member includes lock-receiving recesses that preferably are provided by aligned locking holes in the sides.

The first box member is engageable with the second box member to form an enclosure for the hasp assembly and security seal. Preferably, the open end of the first box member is receivable in the open end of the second box member to form a continuous enclosure for the hasp assembly. When the first box member is received in the second box member, the open ends of the latch slots in the first and second box members overlap to form an enclosed slot on each side of the latch box sized to receive the latch arm extending therethrough.

The lock-receiving recesses in the first and second box members are positioned to cooperate when the first and second box members are engaged so that when a lock is received therein, the first and second box members are locked together and around the latch arm. For example, in the preferred embodiment, the locking holes in the first and second box members are aligned to receive a locking pin therethrough. When a locking pin is engaged in the locking holes in the lock box, the first box member is secured to the second box member with the latch arm in the enclosed latch slots. Thus, the lock box is secured to the hasp assembly over the aligned hasps and any seal therein, thereby obstructing access to the seal and the hasp assembly. Advantageously, the assembled lock box encloses but does not engage the aligned apertures in the hasp assembly

DETAILED DESCRIPTION OF THE PREFERRED EMBODIMENTS

Figure 1:
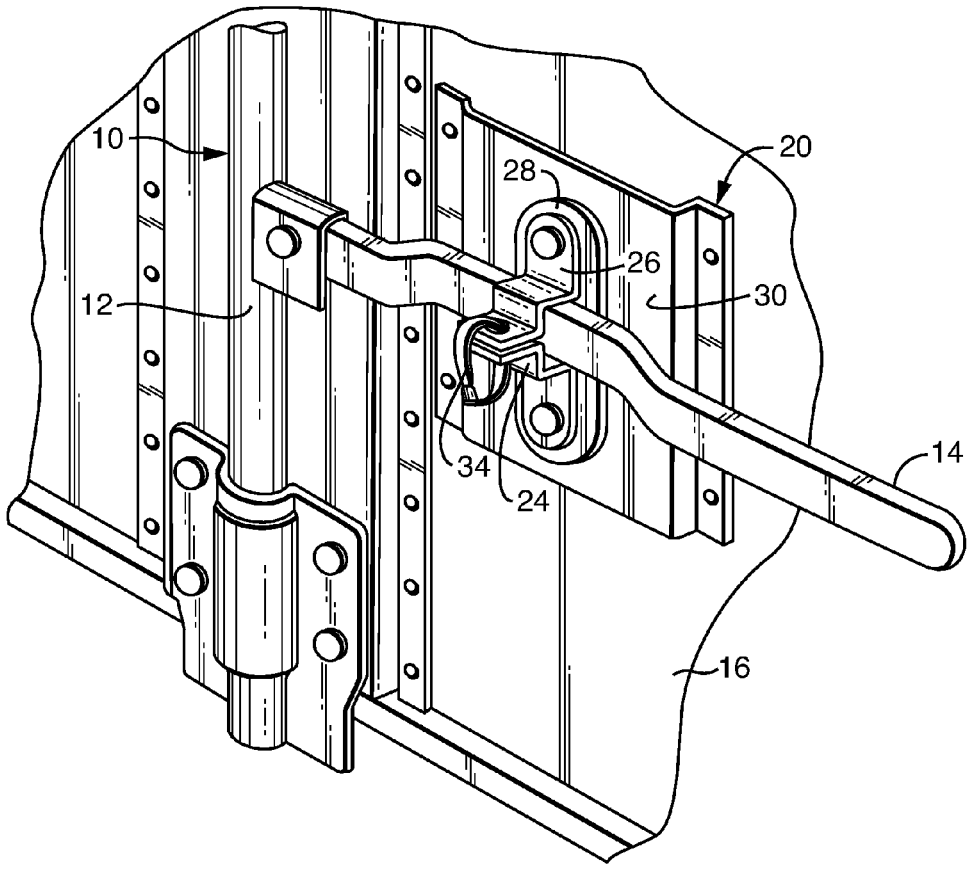
FIG. 1 is a perspective view of a typical latch assembly on the cargo door of a trailer. A conventional plastic security seal is looped through the hasp apertures.

Turning now to the FIGS. 2-6, there is shown therein a lock box assembly made in accordance with a preferred embodiment of the present invention and designated generally by the reference numeral 38. The lock box assembly 38 is designed for use with a latch assembly 10, such as that described above and illustrated in FIG. 1.

With continuing reference to FIGS. 2-6, the lock box assembly 38 comprises a lock box 40, which in turn comprises first and second box members 42 and 44. As seen best in FIGS. 2, 5 & 6, the first box member 42 is formed by a closed end 50, an open end 52, a closed top 54, an open bottom 56 and two closed sides 58 and 60. The first box member 42 is sized and shaped to enclose a first portion of the hasp assembly 20. Preferably, the first box member 42 is adapted to enclose the lower half of the hasp assembly, including the first hasp 24. The dimensions of the first box member 42 should be sufficient to accommodate a variety of types of security seals, including the seal 34.

Figure 2:
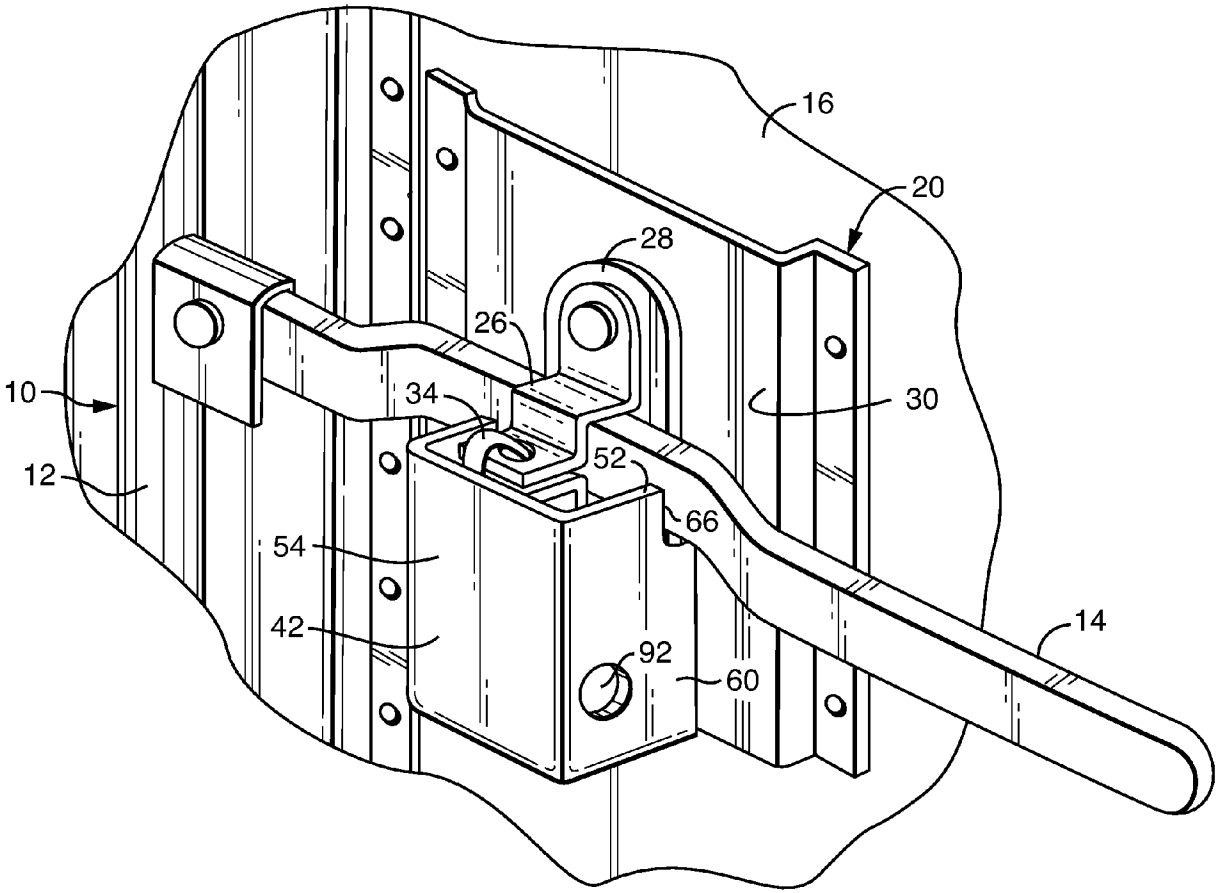
FIG. 2 is a perspective view showing the first box member placed over the lower hasp portion of the latch assembly.
Figure 5:
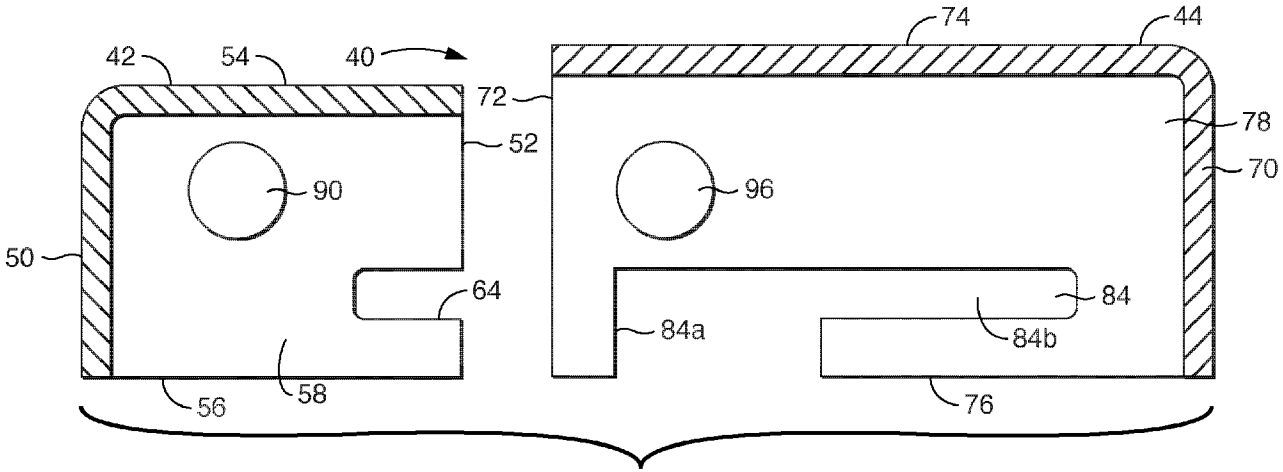
FIG. 5 is an exploded, sectional view of the first and second box members.
Figure 6:
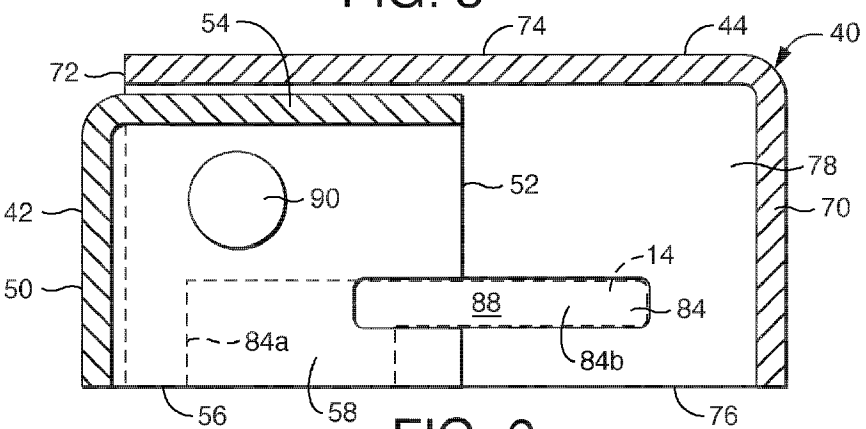
FIG. 6 is an assembled, sectional view of the first and second box members.

Referring still to FIGS. 2, 5 & 6, the first box member 42 includes a latch slot 64 and 66 in each side 58 and 60. Preferably, the latch slots 64 and 66 are straight slots with open ends continuous with the open end 52 of the first box member and extending a distance generally toward the closed end 50. As best seen in FIG. 2, the slots 64 and 66 are sized to receive a portion of the latch arm 14, and preferably to fit closely around the latch arm. Most preferably, the first box arm is shaped to slide in over the lower half of the hasp assembly 20 and around the bottom half of the latch arm 14.

The second box member 44, seen in FIGS. 3-6, is formed by a closed end 70, an open end 72, a closed top 74, an open bottom 76 and two closed sides 78 and 80. The second box member 44 is sized and shaped to enclose a second portion of the hasp assembly 20. Preferably, the second box member 44 is adapted to enclose the upper half of the hasp assembly, including the second hasp 26.

Figure 3:
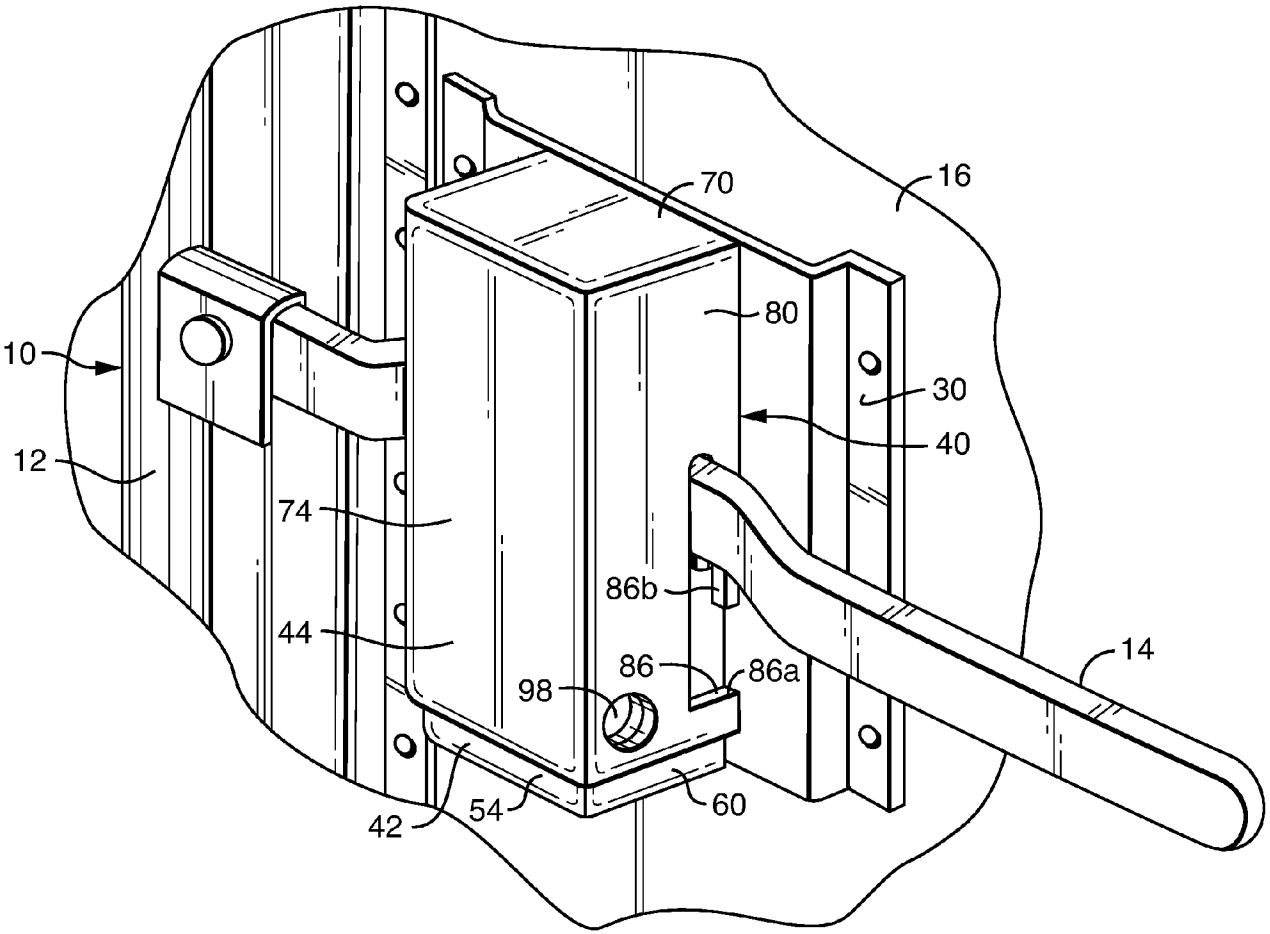
FIG. 3 is a perspective view showing the second box member placed over the first box member and the upper hasp to enclose the latch assembly.
Figure 4:
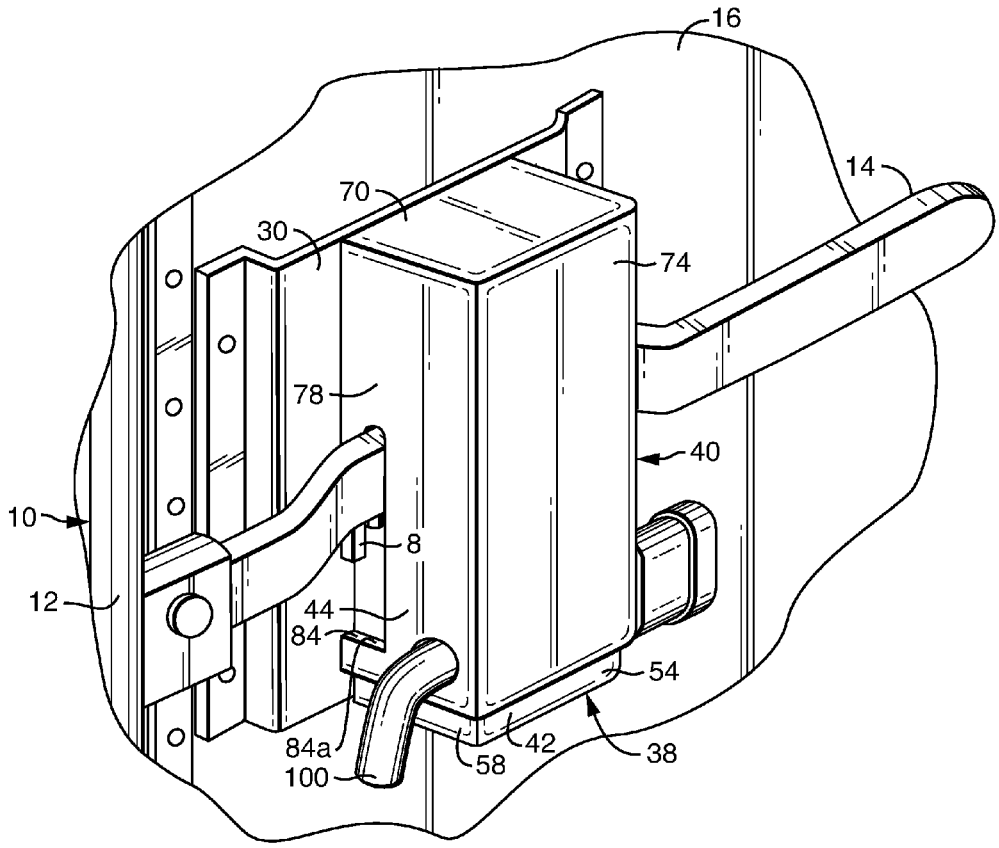
FIG. 4 is a perspective view of the assembled lock box, including a conventional locking pin inserted through the box.

The second box member 44 includes a latch slot 84 and 86 in each side 78 and 80. Preferably, the latch slots 84 and 86 are L-shaped slots with open ends 84*a* and 86*a* continuous with the open bottom 76 of the second box member and straight sections 84*b* and 86*b* that extend a distance generally toward the closed end 70. As best seen in FIGS. 3 and 4, the slots 84 and 86 are sized to receive at least a portion of the latch arm 14, and preferably the entire width of the latch arm. Specifically, the width of the open ends 84*a* and 86*a* are slightly wider than the width of the latch arm 14, and the length of the straight sections 84*b* and 86*b* are at least about the same as the width of the latch arm. Most preferably, the second box member is shaped to slide in over the upper half of the hasp assembly 20 and the first box member 42. Thus, the first box member 42 is received in the open end 72 of the second box member 44 to form a single, continuous enclosure for the entire hasp assembly 20.

More specifically, the second box member 44 is first placed over the upper half of the hasp assembly 20 and the first box member 42 so that the entire latch arm 14 is received in the open ends 84*a* and 86*a* of the slots 84 and 86. Then, the second box member 44 is moved downwardly until the latch arm 14 is positioned fully in the straight (upper) portions 84*b* and 86*b* of the slots 84 and 86, as seen FIGS. 3 and 4. In this position, the latch slots 84 and 86 overlap to form an enclosed slot 88 (FIG. 6) on each side of the lock box 40 that encircles the latch arm 14.

With continuing references to FIGS. 2-6, the first box member 42 also includes aligned locking holes 90 and 92 in the sides 58 and 60 near the closed end 50, and the second box member 44 has aligned locking holes 96 and 98 in the sides 78 and 80 near its open end 72. The locking holes 90, 92, 96 and 98 are positioned so that, when the first and second box members 42 and 44 are engaged, as shown in FIGS. 3, 4 and 6, the holes all are aligned to receive a single locking pin 100 (FIG. 4) therethrough, thereby locking the first and second box members together around the latch arm 14.

When the locking pin 100 is engaged in the locking holes 90, 92, 96 and 98 in the lock box 40, the first box member 42 is secured to the second box member 44 with the latch arm 14 secured in the enclosed latch slots 88. This, in turn, secures the entire lock box 40 to the hasp assembly 20 over the aligned hasps 24 and 26 and any seal 34 therein. In this way, access to the seal 34, as well as the hasp assembly 20, is obstructed.

The lock box members 42 and 44 may be formed of any suitable material, but steel is ideal and preferably stainless steel. The members 42 and 44 may be formed in any suitable manner; cutting the shape from square tubular steel is acceptable. The preferred form for the closed end, the closed top, and two closed sides of both the first and second box members is solid and planar to form a box that is generally rectangular in longitudinal cross section. However, other shapes may be employed.

The embodiments shown and described herein are exemplary. Some elements or features of the present invention may be found in the art and, therefore, have not been described in detail herein. The description and drawings are illustrative only, and changes may be made in the combination and arrangement of the various parts and elements described herein without departing from the spirit and scope of the invention as defined in the following claims. The description and drawings do not point out what an infringement of this patent would be, but rather merely provide one example of how to use and make the invention. The limits of the invention and the bounds of the patent protection are measured by the claims.

What is claimed is:

1. A lock box assembly for a latch assembly comprising a latch arm engageable with a hasp assembly, wherein the hasp assembly comprises first and second hasps with aligned apertures therein to receive a security seal, the hasp assembly being adapted to restrain the latch arm therein, wherein the lock box assembly comprises a lock box including:

a first box member having a closed end, an open end, a closed top, open bottom, and two closed sides, the first box member sized and shaped to enclose a first portion of the hasp assembly, wherein the sides include latch slots with open ends, the latch slots sized to receive a first portion of the latch arm, and wherein the sides have aligned locking holes therethrough;

a second box member having an open end, a closed end, a closed top, and two closed sides, the second box member sized and shaped to enclose a second portion of the closed hasp assembly, wherein the sides of the second box member include latch slots with open ends, the latch slots sized to receive a second portion of the latch arm, and wherein the sides of the second box member have aligned locking holes therethrough;

wherein the open end of the first box member is telescopically receivable in the open end of the second box member to form a continuous enclosure for the hasp assembly;

wherein, when the first box member is received in the second box member, the latch slots in the first and second box members overlap to form an enclosed slot on each side of the lock box sized to receive the latch arm extending therethrough, and the locking holes in the first and second box members are aligned to receive a locking pin therethrough;

wherein, when a locking pin is engaged in the locking holes in the lock box, the first box member is secured to the second box member with the latch arm in the enclosed latch slots so that the lock box is secured to the hasp assembly over the aligned hasps and any seal therethrough, thereby obstructing access to the seal and the hasp assembly.

2. The lock box assembly of claim 1 wherein the closed end, the closed top, and two closed sides of both the first and second box members are solid.

3. The lock box assembly of claim 1 wherein the closed end, the closed top, and two closed sides of both the first and second box members are planar.

4. The lock box assembly of claim 1 wherein the lock box is further defined as being generally rectangular in longitudinal cross section.

5. The lock box assembly of claim 1 further comprising a locking pin.

6. The lock box assembly of claim 1 wherein the open ends of the latch slots on the sides of the first box member are continuous with the open end of the first box member.

7. The lock box assembly of claim 6 wherein the open ends of the latch slots on the sides of the second box member are continuous with the open bottom of the first box member.

8. The lock box assembly of claim 1 wherein the open ends of the latch slots on the sides of the second box member are continuous with the open bottom of the first box member.

9. A lock box assembly for a latch assembly comprising a latch arm engageable with a hasp assembly, wherein the hasp assembly comprises first and second hasps with aligned apertures therein to receive a security seal, the hasp assembly being adapted to restrain the latch arm therein, wherein the lock box assembly comprises a lock box for use with a lock, the lock box including:

a first box member shaped and sized to enclose a first portion of the hasp assembly and comprising a latch-receiving recess sized to receive at least a first portion of the latch arm and a lock-receiving recess adapted to engage the lock;

a second box member shaped and sized to enclose a second portion of the hasp assembly and comprising a latch-receiving recess sized to receive at least a portion of the latch arm and a lock-receiving recess adapted to engage the lock;

wherein the first box member is engageable with the second box member to form an enclosure for the hasp assembly and security seal;

wherein the lock-receiving recesses in the first and second box members are positioned to cooperate when the first and second box members are engaged so that when a lock is received therein, the first and second box members are locked together and around the latch arm; and wherein the assembled lock box encloses but does not engage the aligned apertures in the hasp assembly.

10. The lock box assembly of claim 9 wherein each of the first and second box members is a housing comprising side walls and wherein the latch-receiving recess is formed in the side walls.

11. The lock box assembly of claim 9 wherein each of the first and second box members is a housing comprising side walls and wherein the lock-receiving recess is a hole in the side walls.

12. The lock box assembly of claim 11 wherein the lock-receiving recesses are configured to receive a locking pin.

13. The lock box assembly of claim 12 further comprising a locking pin.

* * * * *